US007985125B2

(12) United States Patent
Kagami et al.

(10) Patent No.: US 7,985,125 B2
(45) Date of Patent: Jul. 26, 2011

(54) DART GAME APPARATUS

(75) Inventors: Satoshi Kagami, Tokyo (JP); Nao Takanashi, Tokyo (JP)

(73) Assignees: Sega Corporation (JP); Kabushiki Kaisha DARTSLIVE (JP)

( * ) Notice: Subject to any disclaimer, the term of this patent is extended or adjusted under 35 U.S.C. 154(b) by 878 days.

(21) Appl. No.: 11/812,497

(22) Filed: Jun. 19, 2007

(65) Prior Publication Data

US 2007/0246887 A1 Oct. 25, 2007

Related U.S. Application Data

(63) Continuation of application No. PCT/JP2005/024088, filed on Dec. 28, 2005.

(30) Foreign Application Priority Data

Dec. 31, 2004 (JP) ..... 2004-382918

(51) Int. Cl.
*A63F 9/24* (2006.01)

(52) U.S. Cl. ..... 463/1; 463/2; 463/5; 463/30; 463/53; 463/31; 473/570; 273/373; 273/378

(58) Field of Classification Search ..... 463/1, 2, 463/5, 30, 31, 53; 473/570; 273/373, 378
See application file for complete search history.

(56) References Cited

U.S. PATENT DOCUMENTS

| | | | | |
|---|---|---|---|---|
| 4,824,121 | A * | 4/1989 | Beall et al. | 273/376 |
| 4,852,888 | A * | 8/1989 | Ross et al. | 273/373 |
| 5,116,063 | A * | 5/1992 | Harlan et al. | 273/376 |
| 6,974,133 | B2 * | 12/2005 | Martin et al. | 273/378 |
| 2004/0169334 | A1 * | 9/2004 | Martin et al. | 273/371 |
| 2006/0239131 | A1 * | 10/2006 | Nathan et al. | 369/30.06 |
| 2009/0062002 | A1 * | 3/2009 | Kotlarik et al. | 463/33 |

FOREIGN PATENT DOCUMENTS

| | | |
|---|---|---|
| CN | 1037662 A | 12/1989 |
| JP | 61-1680 | 1/1986 |
| JP | 01-193600 | 8/1989 |
| JP | 8-110196 | 4/1996 |
| JP | 11-023195 | 1/1999 |
| JP | 11-299947 | 11/1999 |
| JP | 2001-509251 | 7/2001 |
| JP | 2003-159357 | 6/2003 |
| JP | 2004-65973 | 3/2004 |
| WO | WO 91/09267 | 6/1991 |

* cited by examiner

*Primary Examiner* — Pierre E Elisca

(74) *Attorney, Agent, or Firm* — Dickstein Shapiro LLP

(57) ABSTRACT

A dart game apparatus includes an image display body which displays an image of a target; a panel body, which has a plurality of holes each with a cross-sectional size substantially the same as that of an end of a soft dart, which is also formed, extending toward each hole, with an inclined surface in a ridge taken as a border between adjacent holes. A coordinate detecting body is disposed on a front surface of the panel body and detects coordinates of the position of the soft dart, the end of which is inserted into any of the plurality of holes. The coordinate detecting body has at least four rims, in which so as to correspond to the four rims two pairs of a light-emitting sensor section and a light-receiving sensor section for detecting light emitted by the light-emitting sensor section are provided respectively on the rims arranged face-to-face in parallel.

12 Claims, 13 Drawing Sheets

DART GAME APPARATUS

CROSS REFERENCE TO RELATED APPLICATIONS

This application is a continuation of International Application No. PCT/JP2005/024088, filed on Dec. 28, 2005, now pending, herein incorporated by reference. Further, this application is based upon and claims the benefit of priority from the prior Japanese Patent Application No. 2004-382918, filed on Dec. 31, 2004, the entire contents of which are incorporated herein by reference.

TECHNICAL FIELD

The present invention relates to a dart game apparatus in which a player holds a soft dart and throws the soft dart at an image of a target displayed on a monitor.

BACKGROUND ART

A dart board of an electronic dart game apparatus is composed of a disk-like target that is constituted by a bull's-eye located in the divided center, and a board which is provided with a plurality of holes in the form of a honeycomb surrounding the bull's-eye concentrically and circularly and which is sectioned into different scores.

A player throws a dart called "soft dart" at the target, the soft dart being in the form of a resin rod having a thin end. When the soft dart is inserted into one of the holes on a target board of each segment, a shock thus obtained moves the target board backward, whereby an electrical contact is closed. Accordingly, a detection signal is sent to a control circuit, and thereby a predetermined score on the target board is displayed on a display board. When the electrical contact is closed, an electrical contact section is returned elastically, and the target board into which the soft dart is inserted is pushed back, whereby the electrical contact is opened and the target board is returned to the original position thereof.

When the next dart is thrown and inserted into any of the holes on the target board while keeping the soft dart inserted into the target board, the next score is detected.

The end of each dart that projects on the backside of the target board sends a shock to the board sectioned into score units disposed within the target board. This board is equipped with an electrical contact, wherein the electrical contact is closed by the shock, whereby it is detected that the arrows are inserted into the board, and then detection signals are sent to a controller. The controller calculates the scores, which are displayed on a score display section (see, for example, Japanese Unexamined Patent Publication No. 2004-65973 (P.1, FIG. 6) and Japanese Examined Patent Publication No. S61-1680 (P.3, FIG. 4)).

On the other hand, there is a ball-throwing game equipment which is provided with: a plurality of optical sensors for detecting a position through which a thrown ball passes, the optical sensors being provided vertically and horizontally so as to face each other; and a control circuit for sending, on the basis of each signal sent from each optical sensor detecting the position, an image signal of a ball reaching position to a display screen that is a target of an image display device, wherein the size and pattern of the target displayed on the display screen are variably set by performing an input operation on the control circuit.

This ball-throwing game equipment is configured such that a strikeout target is displayed on the display screen, the plurality of optical sensors for detecting the position through which the ball passes are provided face-to-face in vertical and horizontal directions in front of the screen, a controller for sending, on the basis of each signal sent from each optical sensor detecting the position, an image signal of a ball reaching position to the display screen that is a target of an image display device, and the size and pattern of the target displayed on the display screen are variably set by performing an input operation on the controller. This can be implemented as a dart game (see, for example, Japanese Unexamined Patent Publication No. 2003-159357 (P.1 through P.6, FIG. 4)).

Incidentally, in the technologies disclosed in Japanese Unexamined Patent Publication No. 2004-65973 (P.1, FIG. 6) and Japanese Examined Patent Publication No. S61-1680 (P.3, FIG. 4), the design of the target of each electronic dart game is fixed, and the design cannot be changed. Also, since the target is fixed, a dynamic target cannot be obtained.

Furthermore, in such target, although scores can be acquired by means of a shock applied when a dart is inserted, the dart sometimes falls, or scores are obtained by means of a shock caused by things that cannot be inserted. According to the rules of a dart game, such scores do count as the number of dart throws but are not converted to real scores. However, if one does not understand the rules of a dart game, he may misunderstand that scores are obtained and advance in the game, or he may misunderstand that he can throw a dart again and actually throw one.

Moreover, in the technology described in Japanese Unexamined Patent Publication No. 2003-159357 (P.1 through P.6, FIG. 4), the design of the target can be changed by changing an image displayed on the display screen. However, after balls are thrown at the target one by one as with a strikeout, the thrown balls hit the target and then fall, thus the next ball is thrown at the target on which there are no balls.

In the case in which this technology is applied to a dart game, the following problems arise. Three darts are thrown in one round, wherein the dart that is thrown first remains inserted into the target. Therefore, the light from each optical sensor is blocked by the arrow that is thrown first, and, even when the next arrow is inserted into the area where the light is blocked, the optical sensor may not be activated. As a result, the position of a dart that is thrown subsequently cannot be detected.

DISCLOSURE OF THE INVENTION

Therefore, the present invention is contrived in view of the above problems, and an object thereof is to obtain a dart board adopted in a game or a practice machine for competing throw control in which a soft dart or an arrow that is thrown first is inserted into a target and remains inserted on the target, whereby scores are calculated, wherein, when the dart falls after being inserted, the score for the thrown dart is not counted as a point, so that the game can be played according to the original rules of a dart game.

Another object of the present invention is to obtain a dart board in which, even if a dart thrown at the dart board falls without being inserted, the throw can be recognized.

A further object of the invention of the present application is to obtain a dart board in which the pattern or size of the dart board can be freely changed by using an image display body.

Yet another object of the invention of the present application is to obtain a dart game apparatus in which a trouble of replacing/attaching a target can be eliminated by displaying the target on an image display device, and in which the size or pattern of the target is freely displayed on a display screen so that an interesting game or practice can be performed.

Moreover, another object of the present invention is to obtain a dart game apparatus in which a moving image of the target is displayed so that a dart game having the moving image as the target can be played.

In order to achieve such objects, a basic aspect of the invention of the present application is a dart game apparatus, which has an image display device for displaying an image of a target; a panel body which is disposed on a front surface of a display screen of the image display device and through which the image displayed on the display screen of the image display device can be observed; and a coordinate position detecting device that detects a coordinate position of a soft dart abutting and held on the panel body.

A first aspect of the invention of the present application is a dart game apparatus, which has: an image display body which displays an image of a target; a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed; and a coordinate detecting body which is disposed on a front surface of the panel body and detects coordinates of the position of the soft dart, the end of which is inserted into any of the plurality of holes, wherein the coordinate detecting body has at least four rims, in which so as to correspond to the four rims, two pairs of a light-emitting sensor section and a light-receiving sensor section for detecting light emitted by the light-emitting sensor section are provided respectively on the rims arranged face-to-face in parallel and, and the light-receiving sensor sections out of the two pairs detect blockage of light emissions of the light-emitting sensor sections by the soft dart inserted into the panel body, whereby the coordinates of the position of the soft dart are detected.

A second aspect of the invention of the present application is a dart game apparatus, which has: an image display body which displays an image of a target; a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed;

and a first coordinate detecting body layer and a second coordinate detecting body layer, each of which has four rims, and in each of which, so as to correspond to the four rims, two pairs of a light-emitting sensor section and a light-receiving sensor section for detecting light emitted by the light-emitting sensor section are provided respectively on the rims arranged face-to-face in parallel, wherein the second coordinate detecting body layer is disposed at a predetermined displacement angle with respect to the first coordinate detecting body layer, the light-receiving sensor sections out of the two pairs provided in the first coordinate detecting body layer detect blockage of light emissions of the light-emitting sensor sections by not more than two soft darts inserted into the panel body, whereby coordinates of the position of each of the two soft darts are detected, and the light-receiving sensor sections out of the two pairs provided in the second coordinate detecting body layer detect blockage of light emissions of the light-emitting sensor sections by a third soft dart inserted into the panel body, whereby coordinates of the position of the third soft dart are detected.

Furthermore, a third aspect of the invention of the present application is a dart game apparatus, which has: an image display body which displays an image of a target; a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed;

a coordinate detecting body which is disposed on a front surface of the panel body and detects coordinates of the position of the soft dart, the end of which is inserted into any of the plurality of holes; a target coordinate storage section that stores a position coordinate of the image of the target displayed on the image display body; a determination section which calculates a coordinate position of the position of the soft dart inserted into the panel body, by means of a detection signal sent from the coordinate detecting body, and determines whether the coordinate position matches the position coordinate stored in the target coordinate storage section; and a reporting section which reports a result of determination made by the determination section.

Moreover, a fourth aspect of the invention of the present application is a dart game apparatus, which has: an image display body which displays an image of a target; a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed; a first coordinate detecting body layer and a second coordinate detecting body layer, each of which has four rims, and in each of which, so as to correspond to the four rims, two pairs of a light-emitting sensor section and a light-receiving sensor section for detecting light emitted by the light-emitting sensor section are provided respectively on the rims arranged face-to-face in parallel, the second coordinate detecting body layer being disposed at a predetermined displacement angle with respect to the first coordinate detecting body layer, the dart game apparatus further having: a target coordinate storage section which stores a position coordinate of the image of the target displayed on the image display body; a determination section which calculates a coordinate position of the position of the soft dart inserted into the panel body, by means of detection signals sent from the first and second coordinate detecting bodies, and determines whether the coordinate position matches the position coordinate stored in the target coordinate storage section; and a reporting section which reports a result of determination made by the determination section.

A fifth aspect of the invention of the present application is a dart game apparatus, which has: an image display body which displays an image of a target; a substantially transparent panel body in which a plurality of holes each having a cross-sectional size substantially the same as that of an end of a soft dart are adjacent to each other, and an inclined surface extending toward each hole is formed in a ridge taken as a border between adjacent holes, and which is provided in front of the image display body; a coordinate detecting body layer in which a plurality of optical sensors are provided face-to-face in a plurality of intersecting directions on rims surrounding the panel body in order to detect coordinates of the position of the soft dart, the end of which is inserted into a hole of the panel body, the coordinate detecting body layer being provided along a surface of the panel body that emits a detection signal sent from each sensor in each of the intersecting directions; an information storage section which stores image information and position information of the image displayed on the image display body; an image controller which reads the image information from the information storage section to generate an image generation signal, and displays the image on the image display body; a coordinate position calculating section which calculates the position of the soft dart inserted into the panel body, by means of the detection signal from the coordinate detecting body layer; a determination section which uses coordinate information calculated by the coordinate position calculating section to determine whether the coordinates of the position of the soft dart match a position coordinate of the image of the target, the position coordinate being stored in the information storage section; and a reporting section which reports a result of determination made by the determination section.

A sixth aspect of the invention of the present application is a dart game apparatus, which has: an image display body which displays an image of a target; a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed; a first coordinate detecting body layer and a second coordinate detecting body layer, each of which has four rims, and in each of which, so as to correspond to the four rims, two pairs of a light-emitting sensor section and a light-receiving sensor section for detecting light emitted by the light-emitting sensor section are provided respectively on the rims arranged face-to-face in parallel and, the second coordinate detecting body layer being disposed at a predetermined displacement angle with respect to the first coordinate detecting body layer, the dart game apparatus further having: an information storage section which stores image information and position information of the image displayed on the image display body; an image controller which reads the image information from the information storage section to generate an image generation signal, and displays the image on the image display body; a coordinate position calculating section which calculates the position of the soft dart inserted into the panel body, by means of detection signals from the first and second coordinate detecting bodies; a determination section which uses coordinate information calculated by the coordinate position calculating section to determine whether the coordinates of the position of the soft dart match a position coordinate of the image of the target, the position coordinate being stored in the information storage section; and a reporting section which reports a result of determination made by the determination section.

In each of the above aspects, a configuration is possible in which the holes on the panel body are arranged vertically and horizontally at regular intervals in the form of a grid, and optical axes of the optical sensors of the coordinate detecting body are disposed at intervals such that the optical axes intersect with each other at a position corresponding to a substantially center line of each hole in the panel body.

Also, in each of the above aspects, a configuration is possible in which detection time for detecting the detection signal of each optical sensor of the coordinate detecting body is compared with predetermined reference time, and when the detection time is shorter, the determination section determines that the soft dart is not inserted into the dart board, and when the detection time is longer, the determination section determines that the soft dart is inserted into the dart board, and notifies the reporting section of the results of determination.

In each of the above aspects, a configuration is possible in which when determination is made that the soft dart is not inserted into the dart board, the soft dart is counted as one throw, which is then reported to the reporting section, and when determination is made that the soft dart is inserted into the dart board, the soft dart is counted as one throw, which is then reported to the reporting section along with score information corresponding to the detection signal.

A further aspect of the present invention achieving the above-described objects is a dart game apparatus, which has: an image display body which displays an image of a target; a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed; and a coordinate detecting body which is disposed on a front surface of the panel body and detects coordinates of the position of the soft dart, the end of which is inserted in to any of the plurality of holes, wherein the coordinate detecting body has rims forming a hexagon where opposing rims are disposed parallel, in which, so as to correspond to the hexagon, three pairs of a light-emitting sensor section and a light-receiving sensor section for detecting light emitted by the light-emitting sensor section are provided respectively on the rims arranged face-to-face in parallel, two pairs of the light-receiving sensor sections out of the three pairs detect blockage of light emissions of the light-emitting sensor sections by not more than two soft darts inserted into the panel body, whereby coordinates of the position of each of the two soft darts are detected, and another pair of the light-receiving sensor sections out of the three pairs detects blockage of light emissions of the light-emitting sensor sections by a third soft dart inserted into the panel body, whereby coordinates of the position of the third soft dart are detected.

According to the above configuration, the image of the target displayed by the image display body can be observed through the panel body disposed in front of the image display body. The soft dart is inserted into the panel body by throwing the soft dart at the target, and the soft dart inserted into the panel body can be securely detected by the optical sensors of the first coordinate detecting body layer and the second coordinate detecting body layer. Moreover, the position of the inserted soft dart is calculated from the detection signal of the soft dart, determination is made based on the position information of the target that is stored in the target coordinate storage section as to what part of the target the soft dart is inserted, and the result of determination is reported by the reporting section.

Also, the soft darts inserted into the panel body can be securely detected for each hole by the optical sensors of the first coordinate detecting body layer and the second coordinate detecting body layer, thus the positions of the holes into which a plurality of darts are inserted can be securely specified.

PREFERRED EMBODIMENT OF THE INVENTION

Figure 1:
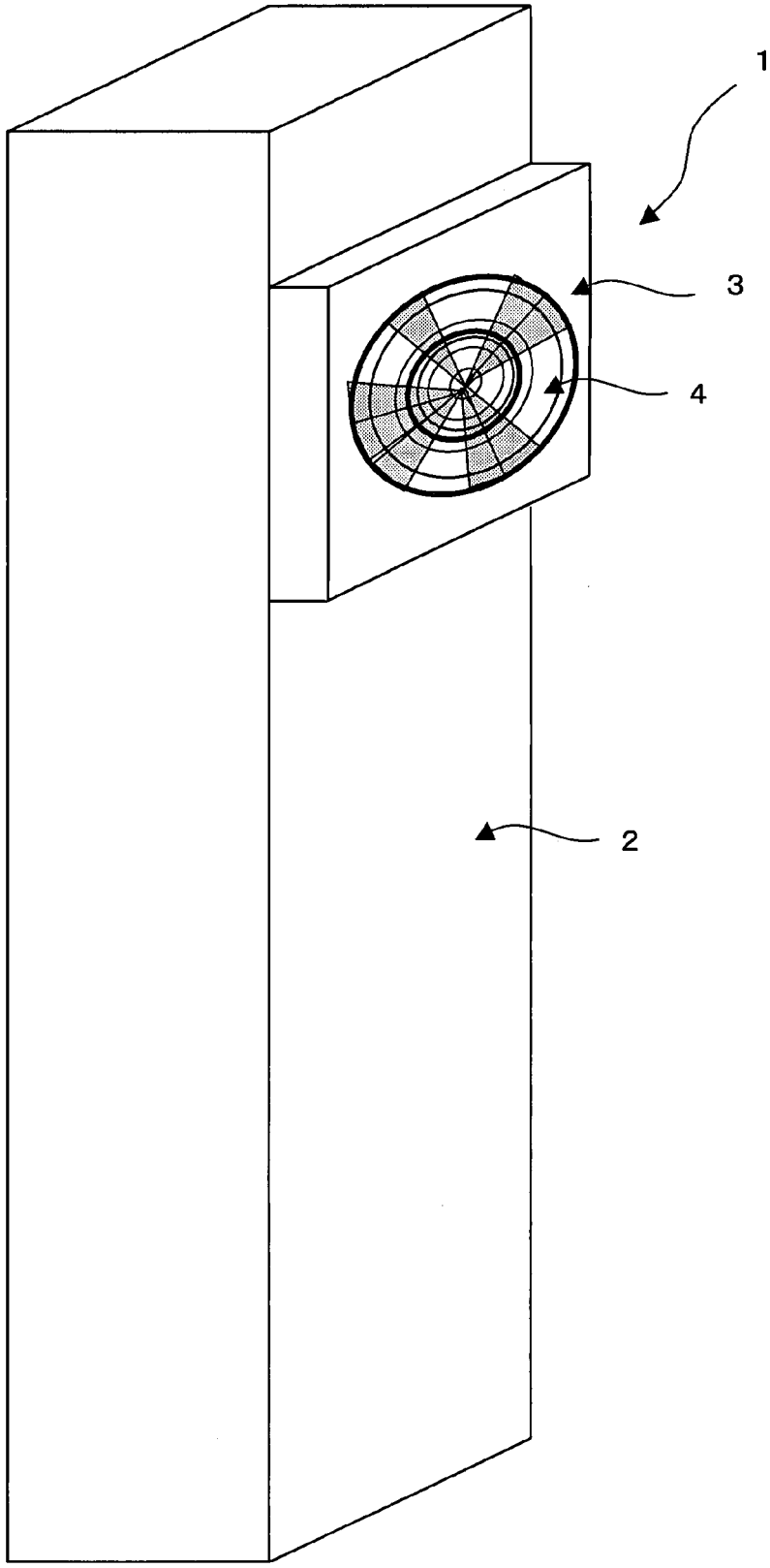
FIG. 1 is an external perspective view of a dart game apparatus.

Hereinafter, embodiments of the dart board and the dart game apparatus using this dart board according to the present invention are described in detail with reference to the embodiments shown in the drawings.

Embodiment 1

The best embodiments of the present invention are described with reference to the drawings. FIG. 1 is an external perspective view of the dart game apparatus according to the present invention. In the dart game apparatus 1, the front surface of a chassis 2 having a vertical rectangular solid form is provided with a dart game board 3 at substantially the eye level of a player in a standing position. The front surface of this chassis is provided with a coin slot, a mode selection switch and the like that are not shown, wherein the player inserts money into the coin slot, presses the mode selection switch to select a game mode, and plays a dart game.

The player stands at a predetermined position in front of the chassis, and throws a soft dart at a target 4 displayed on the dart game board 3. The end of the soft dart 5 that reaches the dart game board 3 is inserted into the dart game board 3, the inserted position on the image is detected, and scores are displayed in accordance with the inserted position.

In FIG. 1, the target 4 that is the same as the one used in a normal dart game is displayed on the dart game boar 3, but an arbitrary static image or video image of a moving image can be displayed according to the invention of the present application.

Figure 2:
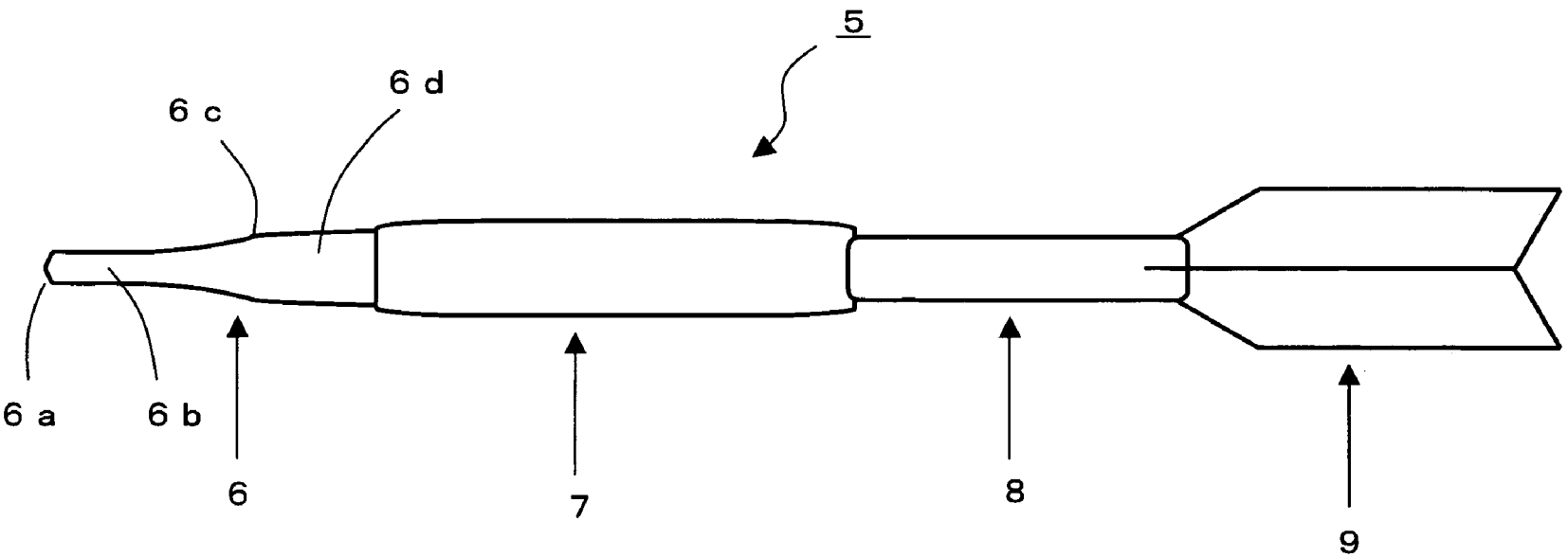
FIG. 2 is a side view of a soft dart.

FIG. 2 shows a side view of an example of the soft dart. All parts of the soft dart 5 are made from the same material except for a metallic dart part and the end of the soft dart 5, and the soft dart 5 is structured with safety measures so that it is not thrust into a person or a wall. The soft dart 5 has a soft tip 6 made of flexible resin at the end thereof, wherein the end is in the form of a short circular cone 6*a*, and a rear section of a small diameter section 6*b* having a diameter of 2 mm forms a circular truncated cone 6*c*, which flares into a skirt-like shape and is connected to a large diameter section 6*d*.

The soft tip 6 is connected to a front end of a metallic barrel 7, a resin shaft 8 is connected to a rear section of the barrel 7, and a flight 9 is provided at a rear section of this shaft. The barrel 7 of the soft dart 5 is held in a hand, and the soft dart 5 is thrown, with the soft tip aiming at the target, whereby the soft dart 5 can be thrown straight.

Figure 3:
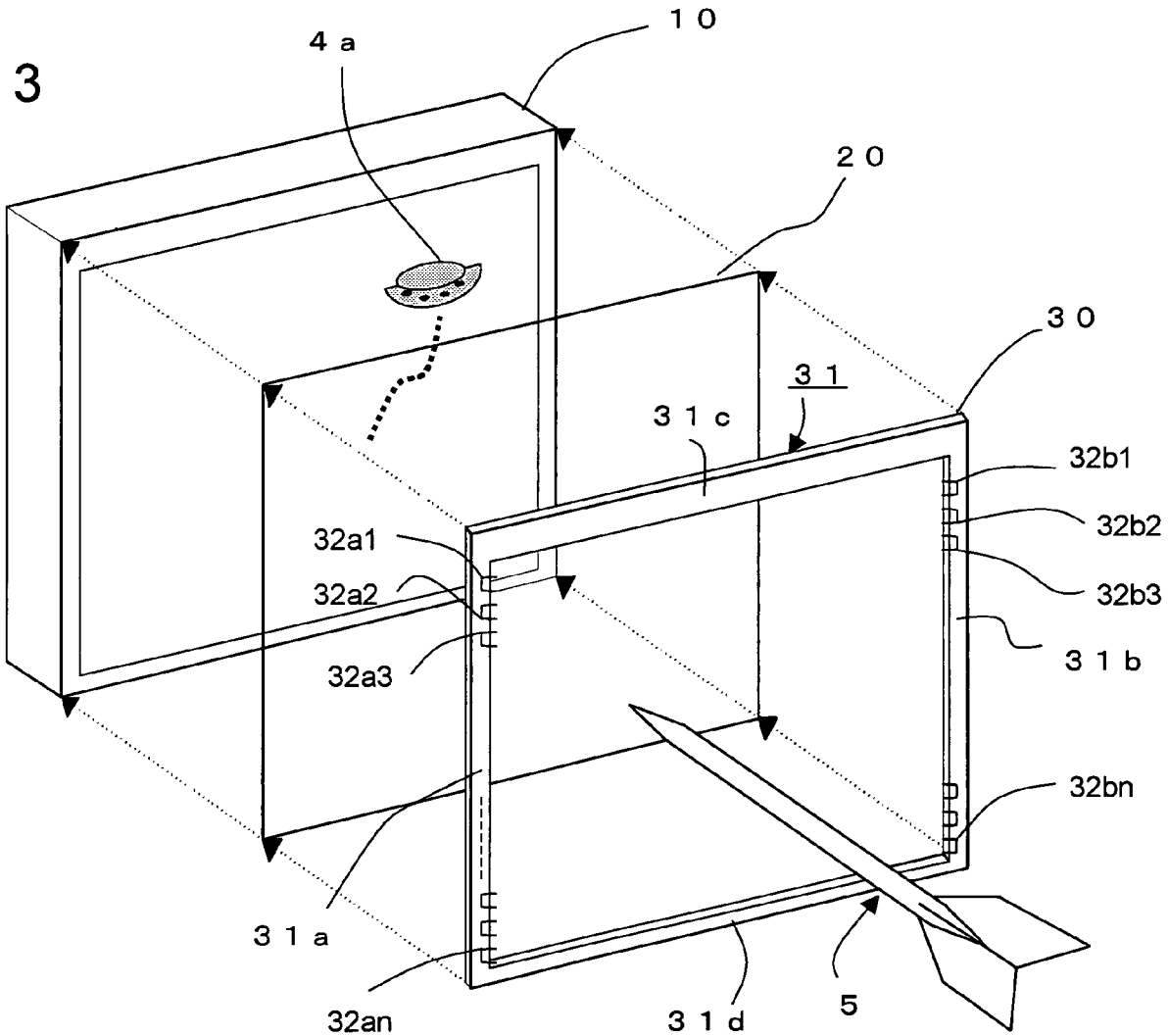
FIG. 3 is an exploded perspective view of a dart game board.
Figure 4:
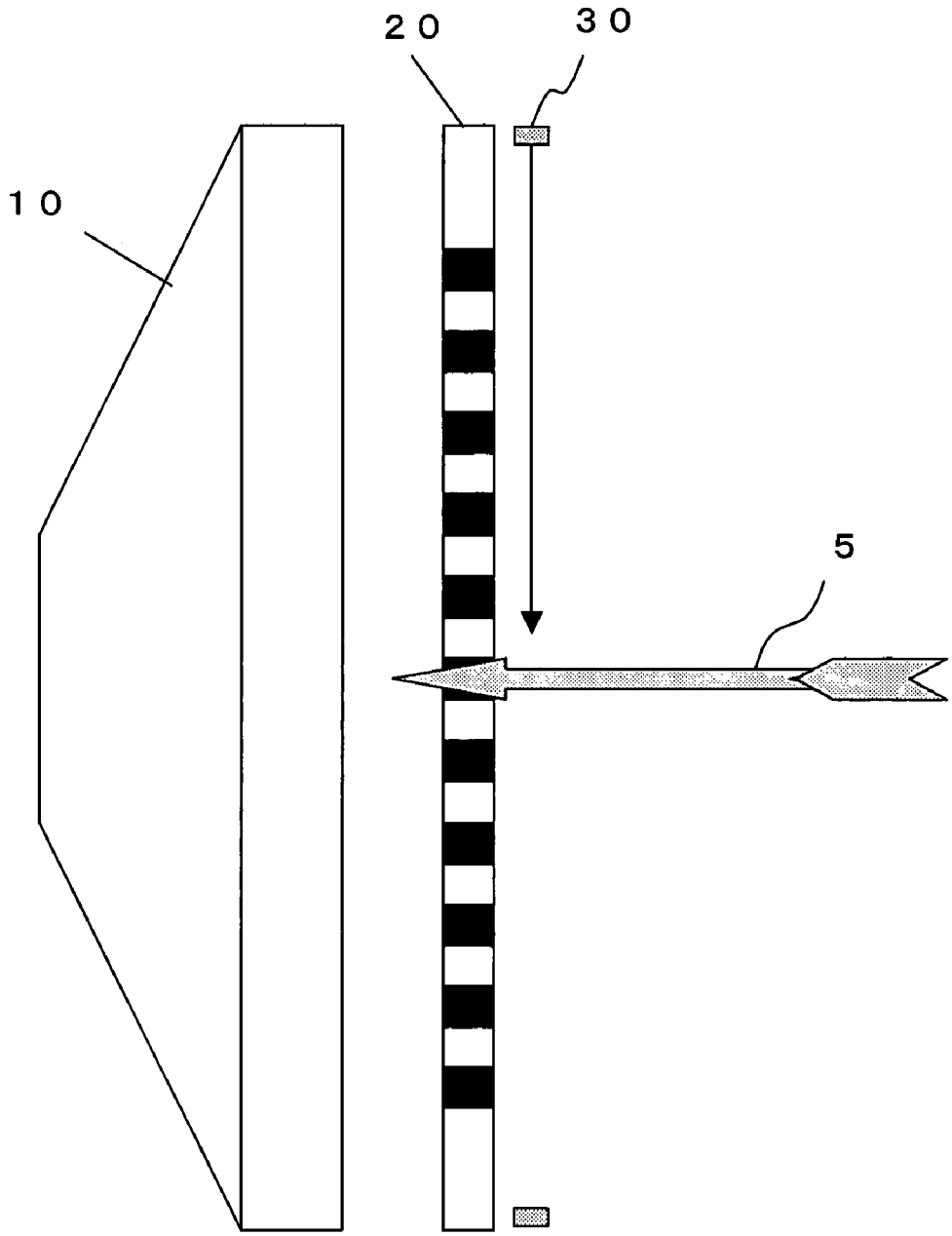
FIG. 4 is a side view of the dart game board.

FIG. 3 is an exploded perspective view of the dart game board 3, and FIG. 4 is a schematic sectional side view of the dart game board 3. At the far side of the dart game board 3, there is disposed an image display device 10, a screen of which displays the target 4 shown in FIG. 1 or a target image 4*a* of a moving object.

The image display device 10 can be realized by a television, plasma display, personal computer, liquid crystal display, monitor device, electronic display board, or the like. A game is played, standing in front of the image display device, thus a monitor device of a rear projector may be used.

When assuming that the image display device 10 is large enough to contain a normal dart board surface, the size of an official dart board surface is 18 inches, thus the size of the image display device 10 is larger than 18 inches.

A transparent panel body 20 into which the thrown soft dart 5 is inserted is attached parallel substantially closely to the screen in front of the image display device 10 so as to be parallel to the screen. In front of the panel body 20, there is provided a coordinate detecting device 30 that detects the position of the soft dart inserted into the panel.

Figure 5:
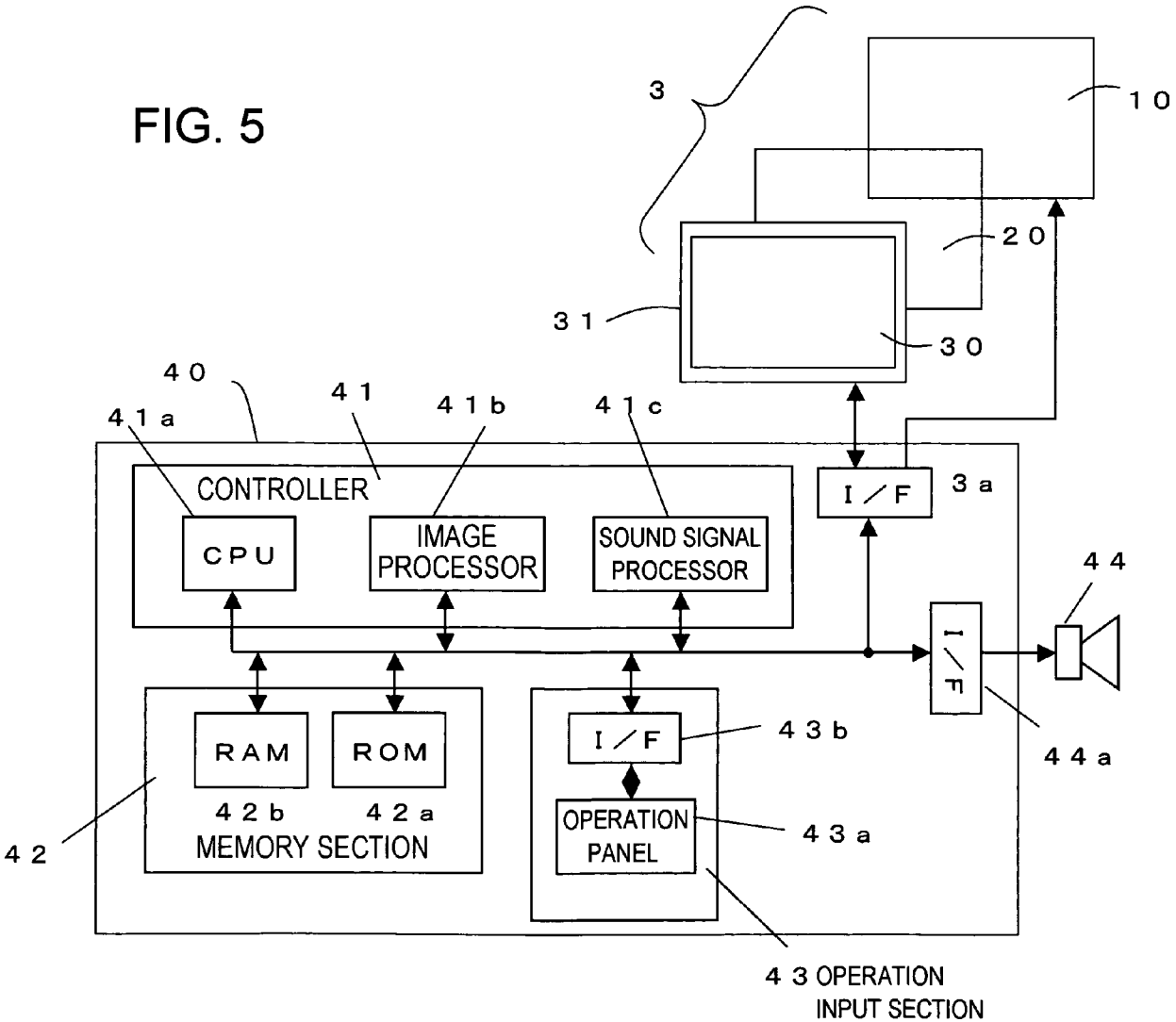
FIG. 5 is a block diagram of hardware of the dart game apparatus.

FIG. 5 is a block diagram of hardware of the dart game apparatus. A control circuit 40 is constituted by a controller 41, a memory section 42, and an operation input section 43. The controller 41 is constituted by a CPU 41*a* that controls the entire system, an image processor 41*b* that performs image processing on a displayed position of a video to be displayed on the screen or the size of the position, and a sound signal processor 41*c* that generates a sound. The memory section 42 is constituted by a ROM 42*a* that stores a program or data used in the controller 41, and a RAM 42*b* that temporarily stores various types of data obtained during a game. Furthermore, in the operation input section 43, an operation panel 43*a* is connected to each of the control blocks 41, 42 via an interface 43*b*, the operation panel 43*a* being used to input various operation signals of a coin switch that detects money for playing a game, a select switch for selecting a game mode, and a start switch.

Once the power is turned on, the CPU 41*a* reads a game program in accordance with a boot program of the ROM 42*a*, causes the image processor 41*b* and the sound signal processor 41*c* to read and process image data and sound data stored in the ROM 42*a*, and outputs a video signal and a sound signal to the image display device 10 and an acoustic device 44 via interfaces 3*a*, 44*a* respectively.

The target 4 is displayed on the screen of the image display device 10. The player inserts the money for playing game into the input section 43, selects a game mode by means of the select switch located on the operation panel 43*a*, and operates the start switch, whereby a dart game starts.

The CPU 41*a* controls the progress of the game in accordance with the game program read from the ROM 42*a*, and uses a coin insertion signal sent from the operation input section 43 and an input signal sent from the select switch and the start switch, to conduct a game mode desired by the player.

The player throws the soft dart at the target 4 from a predetermined distance away from the chassis, and the soft dart is inserted into the panel body 20 of the dart game board 3. In this manner, a game is played. When the soft tip 6, which the player throws at the target 4 displayed on the image display device 10 of the game board, is inserted into the panel body 20, the coordinate detecting device 30 detects the soft tip, and a detection signal obtained from this detection is sent to the controller. Then the CPU 41*a* compares the detection signal with coordinate information stored in the ROM to detect corresponding coordinates, whereby the position where the soft tip is inserted is specified.

The score on the target, which corresponds to the specified position, is read from a table stored in the ROM and counted as a point, and the image processor is caused to display a change in the video image of the target and the point on the image display device 10, while the sound signal processor is caused to generate a sound of a point being scored and to output the sound from a speaker. Accordingly, the control circuit 40 specifies the inserted position on the basis of the detection signal from the coordinate detecting device 30, and added points and the sound are outputted.

The RAM 42*b* successively holds the position information of the target into which the soft tip is inserted, point information, the number of inserted soft darts, and the number of rounds, and the game is proceeded while outputting images and sounds based on these data items. The image processor 41*b* writes image data into the RAM 42*b* on the basis of a computation result of the program, and the written image data is sent to the image display device 10 via the interface (I/F) circuit 3*a*. Also, sound data outputted from the sound signal processor 41*c* is similarly sent to the acoustic device 44 via the interface (I/F) circuit 44*a*.

Figure 6A:
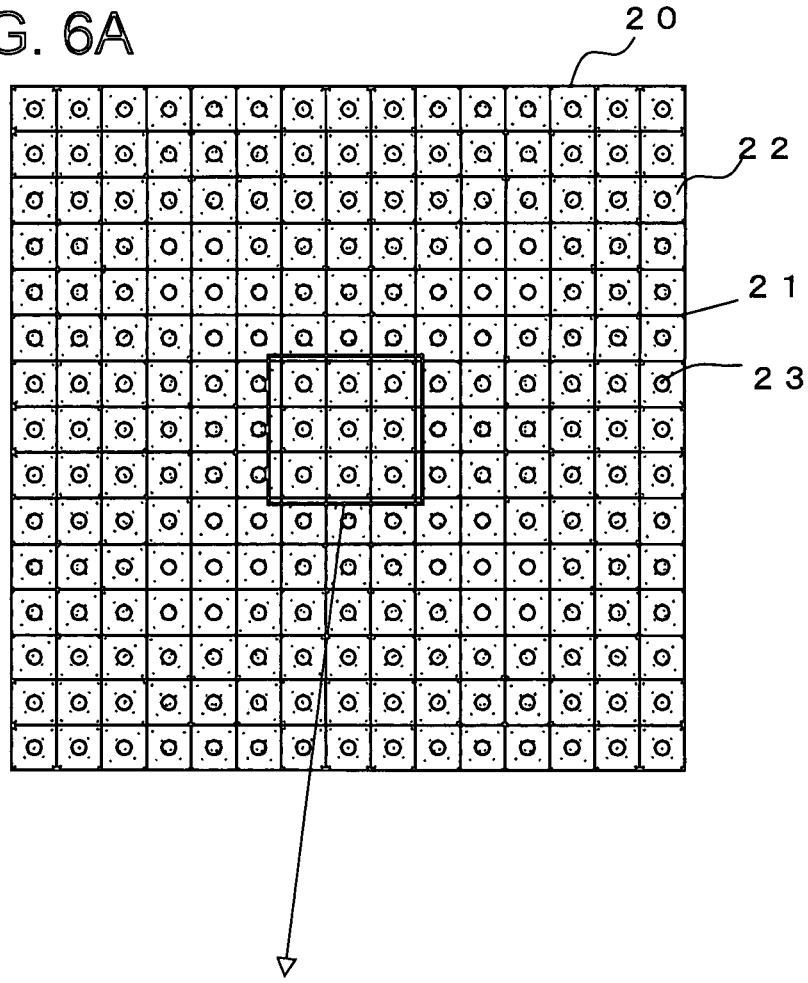
FIG. 6A and 6B show a front view of a panel body.
Figure 6B:
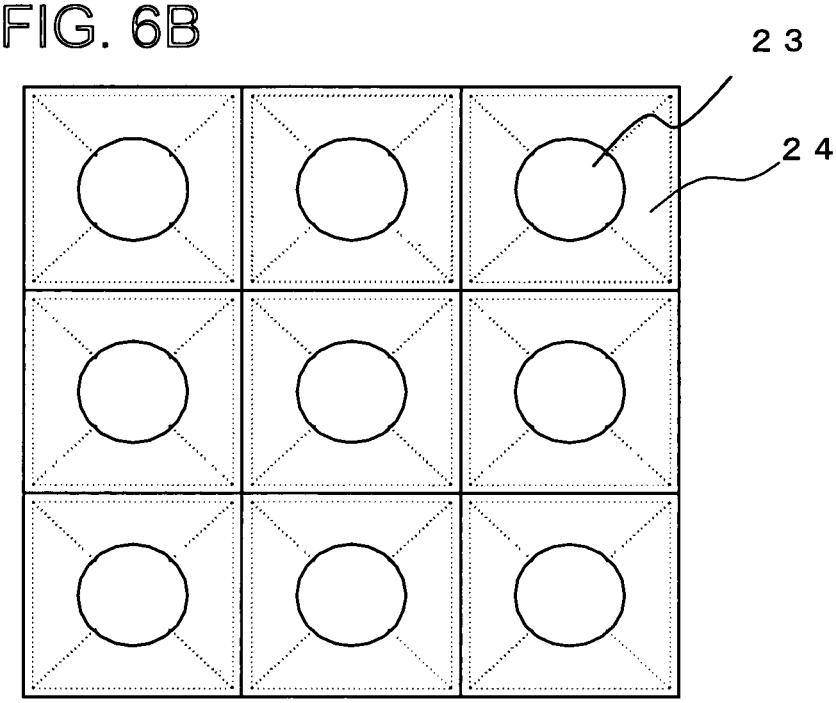
Figure 7:
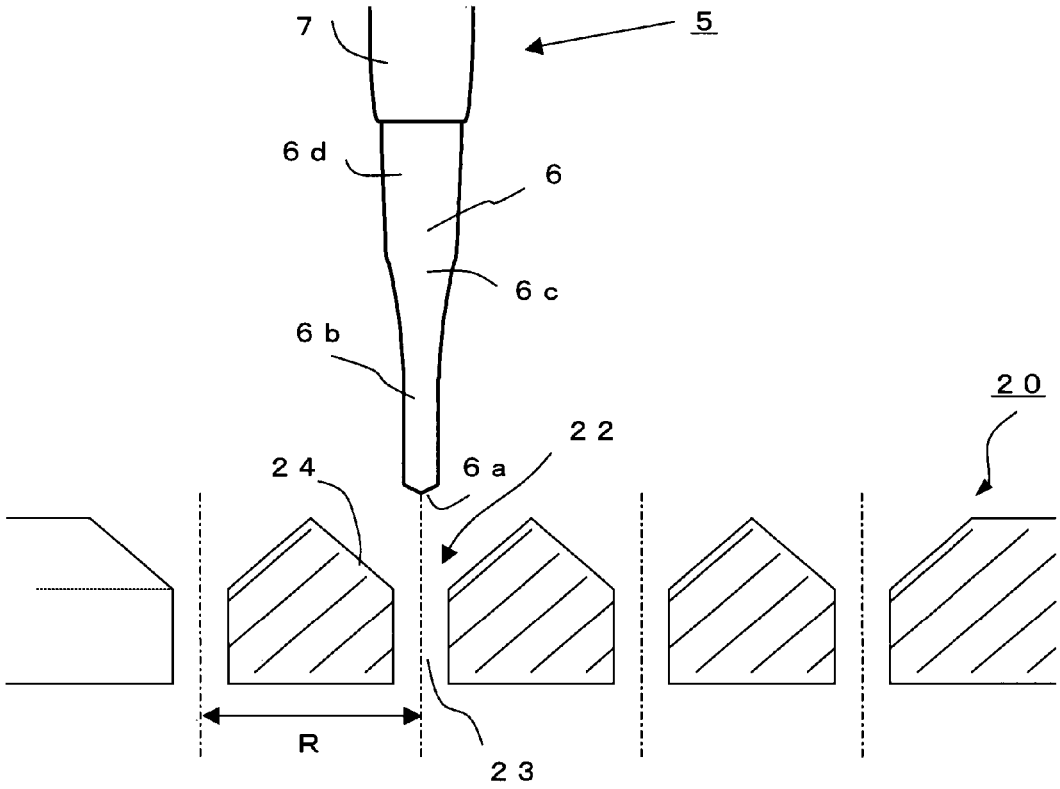
FIG. 7 is a cross-sectional view of a panel.

FIG. 6 is a front view of the panel body 20. FIG. 6A is a front view of the panel body 20, and FIG. 6B is an enlarged view of a bordered square section in the panel body 20 shown in FIG. 6A. FIG. 7 is a cross-sectional view of the panel body 20. The panel body 20 is a substantially transparent plate made of, for example, an acrylic material, and having the size substantially the same as that of the display screen of the image display device 10. The surface of the panel body 20 has diamond-like depressed areas 22 following the shape of a grid 21, and the center of each of the depressed areas 22 has a hole 23 into which the dart is inserted.

On the panel body 20, the girds 21 are disposed vertically and horizontally at a regular interval of approximately 2.5 mm through 4 mm on the surface of the acrylic plate having a thickness of approximately 5 mm, and each of the grids 21 is provided with the diamond-like depressed area 22 in the form of an inverse quadrangular pyramid, on which a downward inclined surface 24 is formed at an angle of 30 through 45 degrees. The center of the depressed area 22 has the round hole 23 having a diameter of approximately 2 mm. The depressed area 22 is formed into a funnel in which the bottom part of the inverse quadrangular pyramid is provided with a cylinder.

By this structure, the soft dart 5 coming to the panel body 20 is inserted into the hole 23. The hole 23 has a section size that is substantially the same as that of the soft tip 6 located at the end of the soft dart.

The soft dart 5 thrown at the panel body 20 normally flies in a direction perpendicular to the surface of the panel body 20. The short circular cone 6*a* in the flexible soft tip of the soft dart 5 can hit anywhere on the surface of the panel body 20. In the case in which the soft tip 6 is inserted directly into the hole 23, the small diameter section 6*b* of the soft tip substantially corresponds to the diameter of the hole 23, thus the small diameter section 6*b* of the soft tip continues to move to the hole, whereby the circular truncated cone 6*c* of the soft tip abuts on the depressed area 22 and then stops.

The surface of the panel body 20 is formed into a grid, wherein the inclined surfaces 24 are configured within the grid, and each of the holes 23 into which the soft tip 6 is inserted is opened in the center of the grid. The area of the surface of the panel body 20 is largely occupied the inclined surfaces 24, thus normally the end of the soft tip 6 hits the inclined surface 24 and slides on the inclined surface 24 in the direction of the hole 23, and is embedded in the hole 23 by being guided by the hole 23, whereby the soft dart 5 is inserted into and held on the panel body 20.

The soft tip 6 is made of a flexible resin, and thus can be twisted by a shock when the dart 5 hits. When the short circular cone 6*a* positioned at the end of the dart 5 collides with the inclined surface 24, the small diameter section 6*b* is twisted in a direction of inclination along the inclined surface, whereby the soft dart 5 is guided to the hole 23.

Furthermore, the soft tip 6 collies with a ridge line of the grid 21. The ridge line that forms a ridge forming a rim line of the grid has the inclined surfaces 24 at both sides thereof at an angle of 90 through 120 degrees, and when the center of the short circular cone 6*a* of the soft tip hits either one of the inclined surfaces 24, the soft tip 6 is distorted in the direction of inclination, whereby the soft dart 5 is guided to the hole 23 positioned at the valley in the direction of inclination.

In this manner, the most of the soft dart thrown at the panel body 20 can be inserted into the hole 23 and held in the hole 23.

Figure 8:
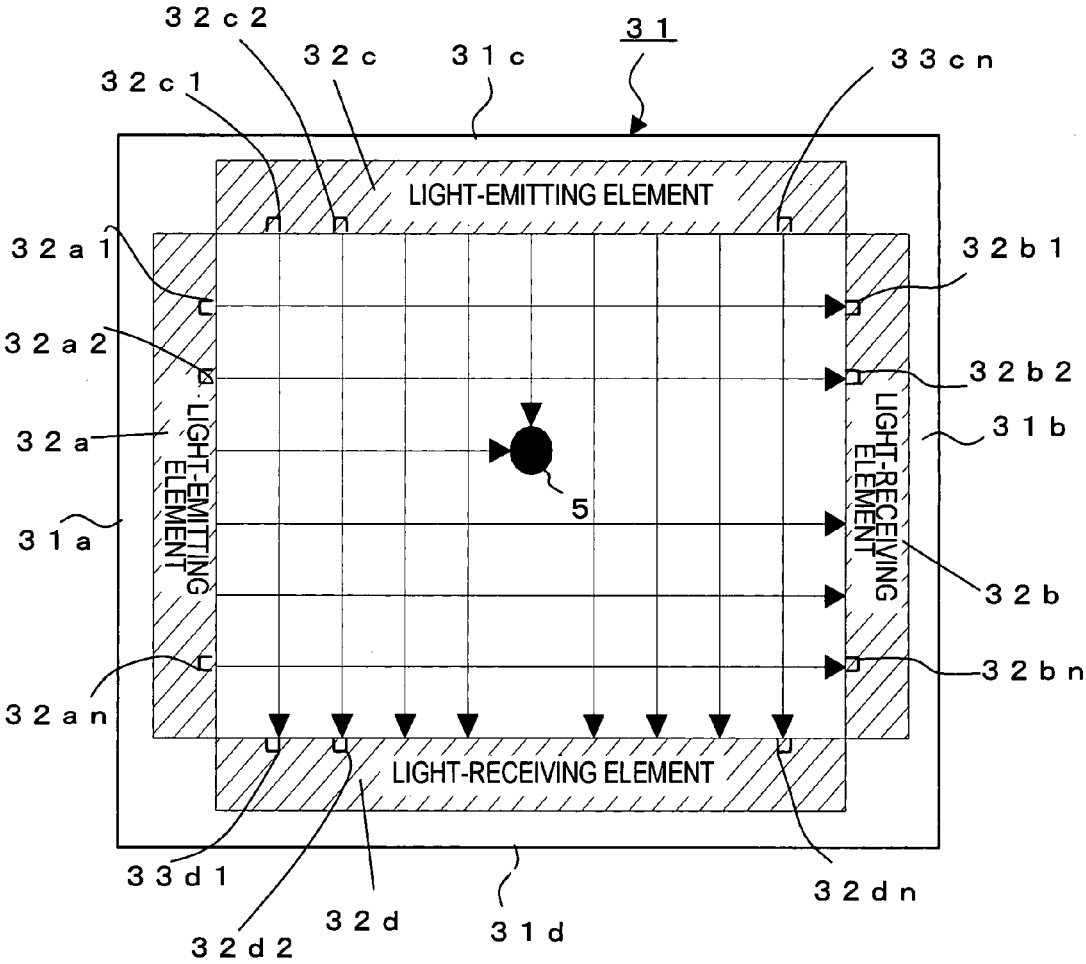
FIG. 8 is a front schematic view of a coordinate detecting device.

FIG. 8 is a front schematic view of the coordinate detecting device 30. The coordinate detecting device 30 is positioned on the front surface side of the panel body 20, and the coordinate detecting device 30 plays a role of detecting the position of the soft dart 5 inserted into the panel body 20.

The coordinate detecting device 30 has a rim body 31 having an appropriate thickness and formed into a rectangle having four rim side sections 31*a*, 31*b*, 31*c* and 31*d* that follow the rims of the display screen of the image display device 10 respectively. The rim body 31 has light-emitting sensor sections 32*a*, 32*c*, and light-receiving sensor sections 32*b*, 32*d* corresponding to the light-emitting sensor sections.

The light-emitting sensor section 32*a* has a plurality of light-emitting elements 32*a*1 and 32*a*2 through 32*an*, while the light-receiving sensor section 32*b* has a plurality of light-receiving elements 32*b*1 and 32*b*2 through 32*bn* correspond to the light-emitting elements respectively.

The light-emitting sensor section 32*c* has a plurality of light-emitting elements 32*c*1 and 32*c*2 through 32*cn*, while the light-receiving sensor section 32*d* has a plurality of light-receiving elements 32*d*1 and 32*d*2 through 32*dn*.

As the light-emitting elements 32*a*1, 32*a*2 through 32*an*, 32*c*1, 32*c*2 through 32*cn*, it is preferred to use, in the embodiment, infrared-emitting diodes, in each of which a light-emitting axis has narrow directional characteristics. As the light-receiving elements 32*b*1, 32*b*2 through 32*bn*, 32*d*1, and 32*d*2 through 32*dn*, on the other hand, high-sensitive PIN photodiodes can be used.

It is preferred that the installation intervals among the light-emitting elements 32*a*1, 32*a*2 through 32*an*, 32*c*1, 32*c*2 through 32*cn*, and among the light-receiving elements 32*b*1, 32*b*2 through 32*bn*, 32*d*1, and 32*d*2 through 32*dn* be a pitch width R between the holes of the panel body 20 (see FIG. 7).

The light-emitting sensor sections 32*a* (light-emitting elements 32*a*1, 32*a*2 through 32*an*) and the light-emitting sensor sections 32*c* (32*c*1, 32*c*2 through 32*cn*) are controlled by the control circuit 40 and are, during a game, in a light-emitting state in which current is constantly applied. Each of the opposing light-receiving sensor sections 32*b* (light-receiving elements 32*b*1, 32*b*2 through 32*bn*) and 32*d* (light-receiving elements 32*d*1, 32*d*2 through 32*dn*) is constantly in a light-receiving state, and a light-reception signal from each of the light-receiving bodies 32*b* and 32*d* is sent to the control circuit 40.

Accordingly, the soft dart 5 is inserted into any of the holes on the panel body 20, whereby the light axes that are emitted from the pair of the light-emitting sensor section 32*a* (light-emitting elements 32*a*1, 32*a*2 through 32*an*) and the light-emitting sensor section 32*c* (light-emitting elements 32*c*1, 32*c*2 through 32*cn*) passing through the hole in X and Y directions respectively are blocked. Accordingly, the corresponding light-receiving sensor section 32*b* (light-receiving elements 32*b*1, 32*b*2 through 32*bn*) and light-receiving sensor section 32*d* (light-receiving elements 32*d*1, 32*d*2 through 32*dn*) cannot receive the light, thus the light-reception signals are not sent to the control circuit 40. The control circuit 40 detects any of the elements of the light-receiving sensor section 32*b* (light-receiving elements 32*b*1, 32*b*2 through 32*bn*) and any of the elements of 32*d* (32*d*1, 32*d*2 through 32*dn*) by which the light is not received, whereby the position of X and Y coordinates of the soft dart 5 inserted in the panel body 20 can be specified.

Embodiment 2

Here, in the case in which the target 4 shown in FIG. 1 is displayed to play a normal dart game, the game is executed in a way of competing for total points by throwing the soft dart 5 a number of times (three times). In this case, in the configuration of the coordinate detecting device 30 shown in FIG. 8, there may arise a problem that, when the soft dart 5, which is thrown first, remains inserted in the panel body 20, the emitted light is blocked, whereby the coordinate position of the soft dart 5 that is subsequently thrown cannot be detected.

Therefore, in the second embodiment, the configuration shown in FIG. 8 is taken as a first detection layer 32, and a second detection layer 33 is further provided in this configuration, whereby the abovementioned problem can be resolved.

Figure 9:
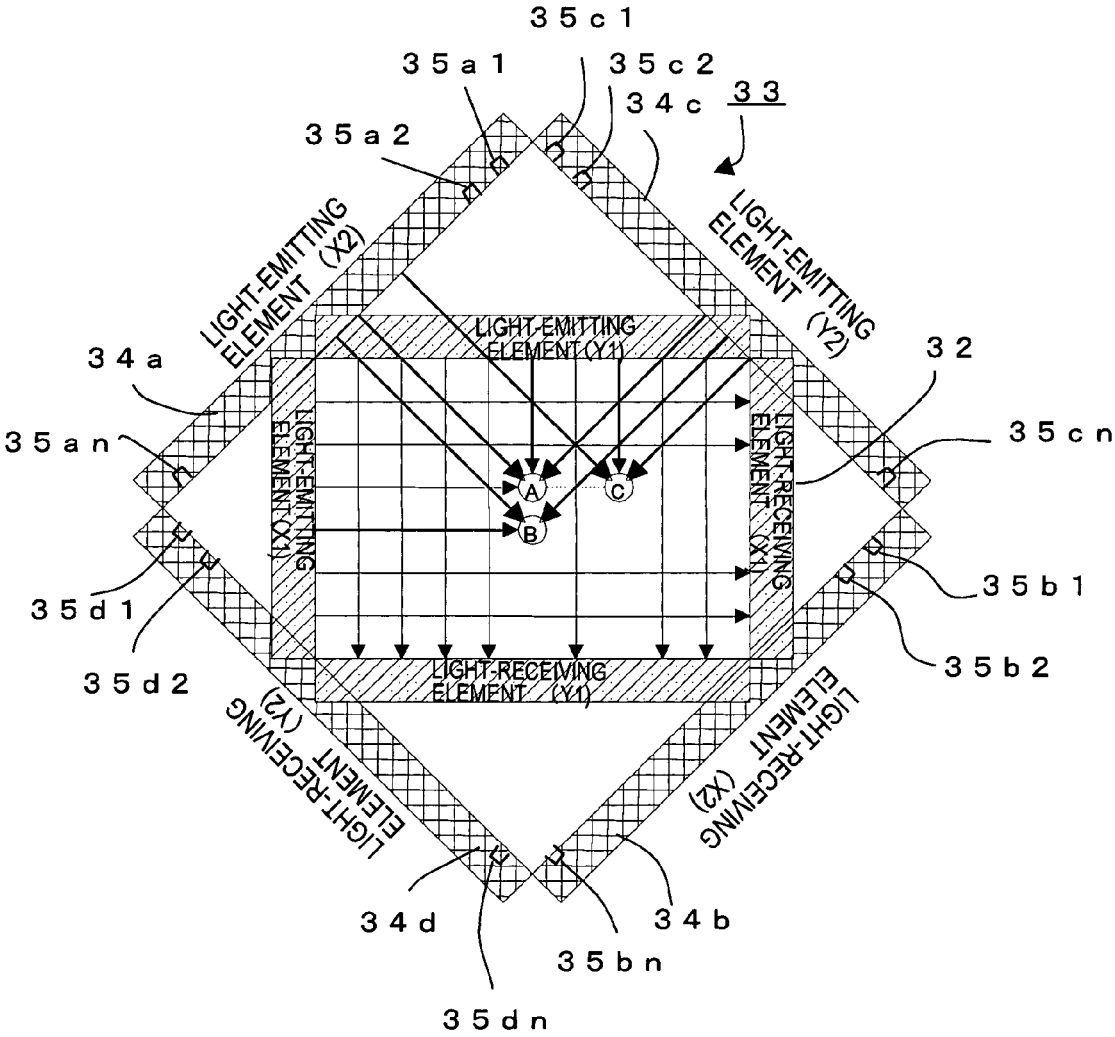
FIG. 9 is an explanatory diagram in which a second detection layer is added to a first detection layer shown in FIG. 8.

Specifically, as shown in FIG. 9, the second detection layer 33 is provided with the pair of light-emitting sensor sections 34*a*, 34*c*, and the pair of light-receiving sensor sections 34*b*, 34*d*, and the first detection layer 32 is provided with the same in an oblique direction (with angle). Although FIG. 9 shows the second detection layer 33 on the outside of the first detection layer 32 for the reason of explanation, actually the second detection layer 33 is provided in the same plane as the first detection layer 32 of the rim body 31, or on the front or far side of the first detection layer 32.

Here, for the reason of explanation, the second detection layer 33 is positioned in the inclined rim body (referred to as "inclined rim body" hereinafter) in front of the first detection layer 32.

In the second detection layer 33, the light-emitting sensor section 34*a* is disposed in an upper left rim section of the inclined rim body, and the light-receiving sensor section 34*b* corresponding to the light-emitting sensor section 34*a* is disposed in a lower right rim section of the inclined rim body.

Similarly, the light-emitting sensor section 34*c* is disposed in an upper right rim section of the inclined rim body, and the light-receiving sensor section 34*d* corresponding to the light-emitting sensor section 34*c* is disposed in a lower left rim section of the inclined rim body.

As in the first detection layer 32 described in FIG. 8, the light-emitting sensor sections 34*a* and 34*c* have, respectively, a plurality of infrared-emitting diodes 35*a*1, 35*a*2 through 35*an*, and 35*c*1, 35*c*2 through 35*cn*, in each of which a light-emitting axis has the narrow directional characteristics.

On the other hand, the light-receiving sensor sections 34*b* and 34*d* have, respectively, a plurality of high-sensitive PIN photodiodes 35*b*1, 35*b*2 through 35*bn*, and 35*d*1, 35*d*2 through 35*dn*, as the light-receiving elements.

It is preferred that the installation intervals among the light-emitting elements and among the light-receiving elements be the pitch width R in which the light-axis of each light-emitting element passes through the hole 23 of the panel body 20, as described in FIG. 8.

Here, FIG. 9 is used to explain a case in which the soft dart 5 is inserted into A, B and C of the panel body 20 in this order.

First, the position of A can be detected by detection signals obtained from the pair of the light-emitting sensor section 32*a* and the light-receiving sensor section 32*b*, and the pair of the light-emitting sensor section 32*c* and the light-receiving sensor section 32*d* of the first detection layer 32.

Next, when the soft dart is inserted into the B position, the X coordinate position on the first detection layer 32 overlaps with that of the A position, whereby the light emitted from the light-emitting sensor section 32*c* is blocked. However, since the Y coordinate is different from that of the A position, the Y coordinate is detected by detecting light emission of the light-emitting sensor section 32*a*, whereby the B position can be specified.

Moreover, when the soft dart is inserted into the C position, the X coordinate can be detected in the first detection layer 32, but whether the X coordinate overlaps with that of the A position or B position cannot be detected.

In this manner, when three or more soft darts are inserted, and if the position of the third soft dart overlaps with the X coordinates or Y coordinates of the previous two soft darts, then the third inserted position cannot be specified.

Therefore, in addition to the first detection layer 32, the second detection layer 33 performs detection from the oblique direction by means of light emission of the light-emitting sensor sections 34*a* and 34*c*. Accordingly, all coordinate positions of the A position, B position and C position can be specified.

By applying the position detection performed by the second detection layer 33 to the position detection performed by the first detection layer 32, the positions of the three soft darts can be specified no matter where these soft darts are inserted.

Here, the holes 23 on the panel body 20 are arranged orderly in vertical and horizontal directions at regular intervals in the form of a grid, and the optical sensors of the first detection layer 32 and the second detection layer 33 (the relationship between the light-emitting sensor section 32*a* and the light-receiving sensor section 32*b*, and the relationship between the light-emitting sensor section 32*c* and the light-receiving sensor section 32*d*) are disposed so as to intersect with each other at a position corresponding to a substantially center line of each hole 23 on the panel body 20.

Furthermore, by comparing the detection time for detecting the detection signal of each optical sensor with predetermined reference time, whether or not the soft dart 5 is inserted into the panel body 20, or whether the soft dart 5 falls without being inserted can be determined.

The reference time represents a basis for distinction between a case where the soft dart 5 bounces off the panel body 20 and falls, and a case where the soft dart 5 is securely inserted, and, for example, 0.5 seconds or 1 second is set as this reference time. If the reference time is set to a longer time period, a quick response cannot be obtained even if the soft dart is inserted securely, slowing response time.

As the determination section, the CPU 41*a* of the controller 41 functions by means of the program processing. When the detection time is shorter than the reference time, it is determined that the soft dart 5 is not inserted into the panel body 20. When the detection time is longer, it is determined that the soft dart 5 is inserted into the panel body 20. A determination result is displayed on the image display device 10 as a change in the video, or displayed on a lamp or score display section provided in the chassis 2, and then reported to the player by outputting sound from the acoustic device 44.

When it is determined that the soft dart 5 is not inserted into the panel body 20, the soft dart 5 is detected as one throw, the number of times that the soft dart 5 is thrown is counted sequentially, and thus obtained count values are stored in the memory section 42. The count values are displayed as an image on the image display device 10, or simultaneously reported to the player as a sound. When it is determined that the soft dart 5 is inserted into the panel body 20, the throw of the soft dart 5 is counted as one throw, the number of times that the soft dart 5 is thrown is stored as data into the memory section 42, and the data is reported to the player along with score information corresponding to the detection signal.

It should be noted in Embodiments 1 and 2 that the first detection layer 32 is configured such that the light-emitting sensor section 32*a* is provided in the vertical rim section 31*a* on the left-hand side of the light-emitting sensor section 32*a* and in the horizontal rim section 31*c* on the upper side, while the light-receiving sensor section 32*b* is provided in the vertical rim section 31*b* on the right-hand side of the light-receiving sensor section 32*b* and in the horizontal rim section 31*d* on the lower side. However, the light-emitting element and the light-receiving element may be configured face-to-face, thus the light-emitting sensor section 32*a* and the light-receiving sensor section 32*b* may be provided in either one of the vertical rim section 31*a* and the vertical rim section 31*b*, the vertical rim section 31*a* being positioned on the left-hand side of the light-emitting sensor section 32*a* and the vertical rim section 31*b* being positioned on the right-hand side of the light-receiving sensor section 32*b*. Similarly, the light-emitting sensor section 32*c* and the light-receiving sensor section 32*d* may be provided in either one of the horizontal rim section 31*c* on the upper side and the horizontal rim section 31*d* on the lower side.

Furthermore, in order to prevent a false operation from being caused by the sunlight, the light-receiving sensor sections 32*b* and 32*d* each may be masked by a cut-on filter that allows the passage of only light with a wavelength of at least 6 through 7 μm in order to block the sunlight. Also, the light-emitting sensor sections 32*a* and 32*c* may be configured to be able to emit light in the form of pulses.

Moreover, as with the configuration of the first detection layer 32, the second detection layer 33 may be configured such that the light-emitting sensors 34*a*, 34*c* and the light-receiving sensor sections 34*b*, 34*d* are disposed face-to-face.

Embodiment 3

In Embodiment 2 described above, the first and second detection layers 22, 23 are provided so that three coordinate positions can be detected by means of the presence or absence of blockage of light emitted by the light-emitting sensor sections 32*a*, 32*c*, 34*a*, 34*c* (ON/OFF of the amount of light).

Figure 10:
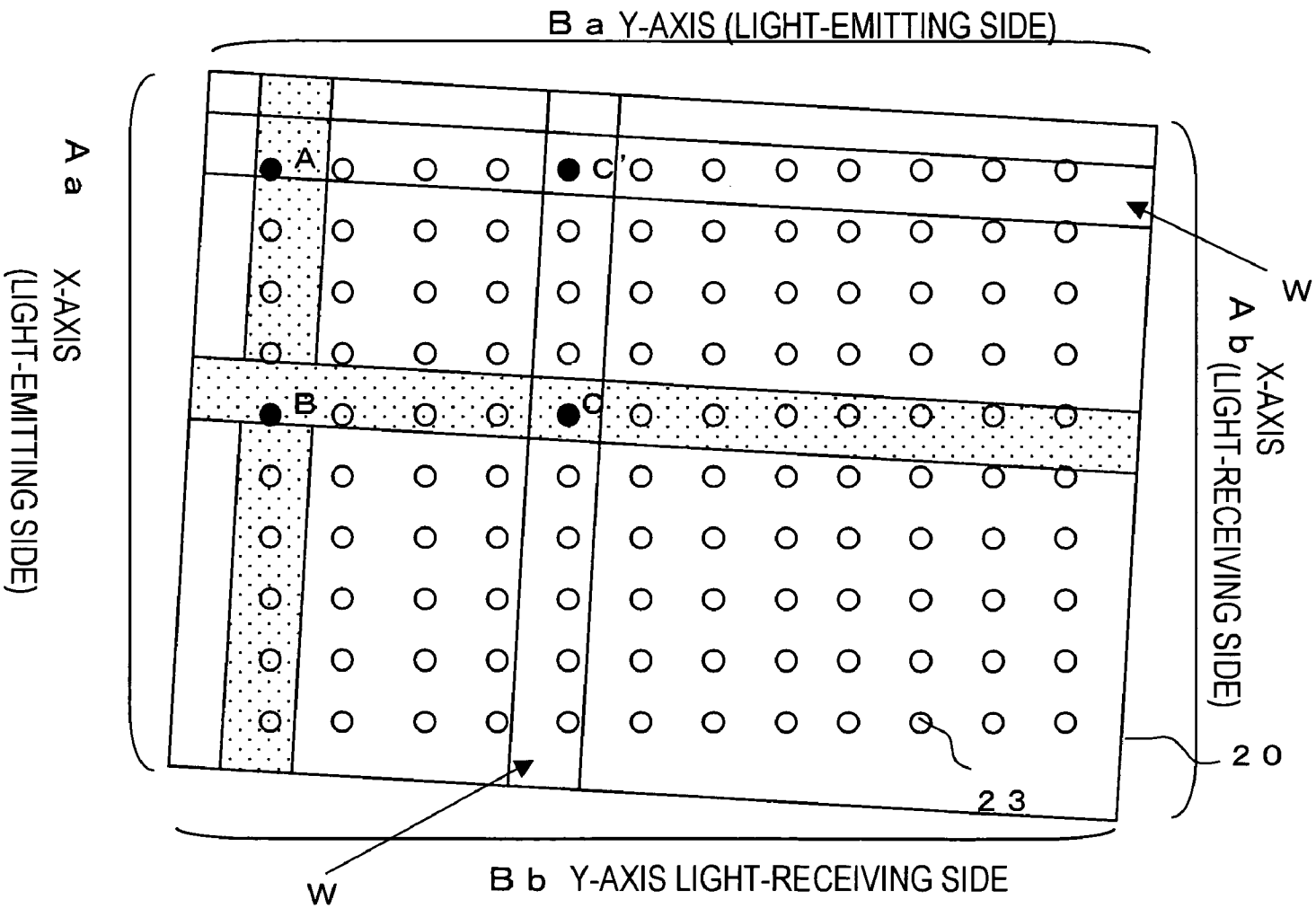
FIG. 10 is a figure showing a configuration example in which a coordinate position is detected by means of a change in the amount of light received by a light-receiving element.

On the other hand, the embodiment shown in FIG. 10 is configured so as to detect the coordinate positions by means of the changes in the amount of light received by the light-receiving elements. Accordingly, as compared with FIG. 9, the three coordinate positions can be detected using only one detection layer.

Specifically, as shown in FIG. 10, corresponding axes of the light-emitting sensor sections (light-emitting sides) and of the light-receiving sensor sections (light-receiving sides) are disposed in an inclined manner with respect to the panel body 20 in which the holes 23 into which the soft dart 5 is inserted are arranged in the form of a matrix in the X-axis direction and the Y-axis direction.

On the other hand, a sensor recognizing range W is inclined with respect to the arrangement of the holes 23 of the panel body 20.

Accordingly, for example, in FIG. 10 the amount of light detected by the light-receiving side on the X-axis changes even in the X coordinate same as that of the position B, while the amount of light received by the light-receiving side in the position A does not change, thus the position C can be distinguished from the position C'.

Figure 11:
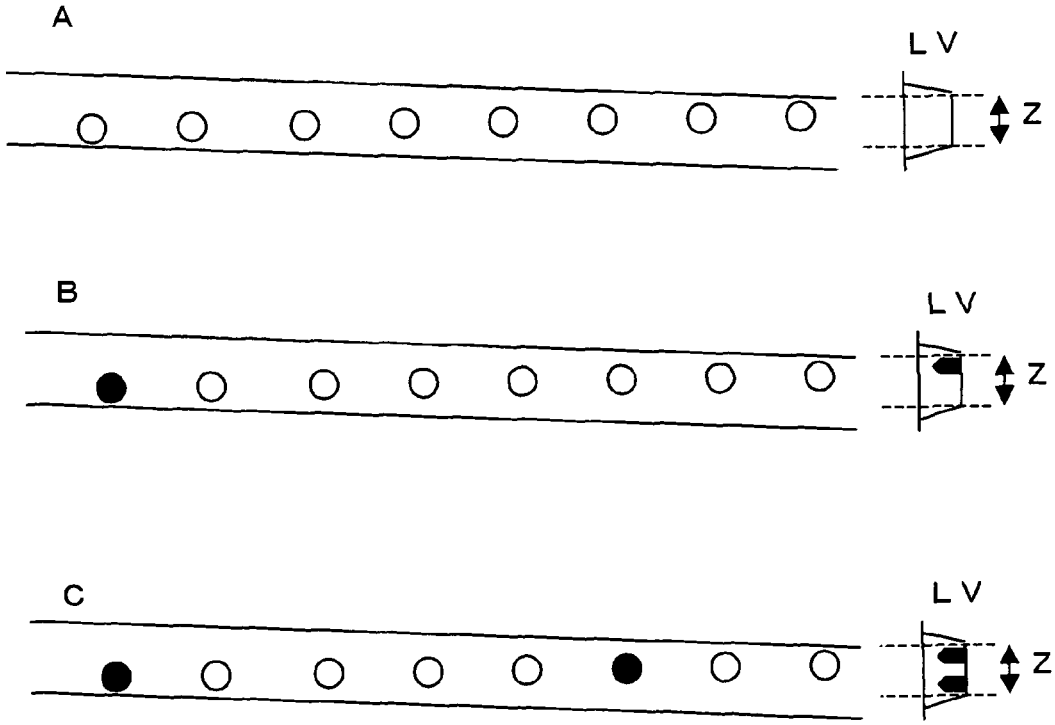
FIG. 11 is a figure for explaining operation of the embodiment of FIG. 10.

Furthermore, to describe FIG. 11, FIG. 11A shows the amount of sensor light on the light-receiving side in the case in which none of the soft darts is inserted into the panel body 20, wherein the amount of light received LV in a detection range Z is 100%.

On the other hand, FIG. 11B shows a state in which the soft dart is inserted into A or B shown in FIG. 10. The amount of received light becomes lower than the amount of light received LV shown in FIG. 11A (e.g., the amount of received light becomes ⅔ of [LV]).

Also, FIG. 11C shows a state in which the soft darts are inserted into A and C' or B and C in FIG. 10. Compared to the states shown in FIG. 11A and FIG. 11B, the amount of received light is further reduced (e.g., the amount of received light becomes ⅔ of [LV]).

Accordingly, in Embodiment 1 in which the first light-receiving layer 22 is used, it is not possible to determine whether the third soft dart is inserted into the position of C or C' after soft darts are inserted into A and B. In Embodiment 2, on the other hand, the third position can be determined by using the second light-receiving layer 23.

In Embodiment 4 shown in FIG. 10, on the other hand, the change in the amount of light are used so that the three coordinate positions can be detected by means of one light-receiving layer.

Figure 12:
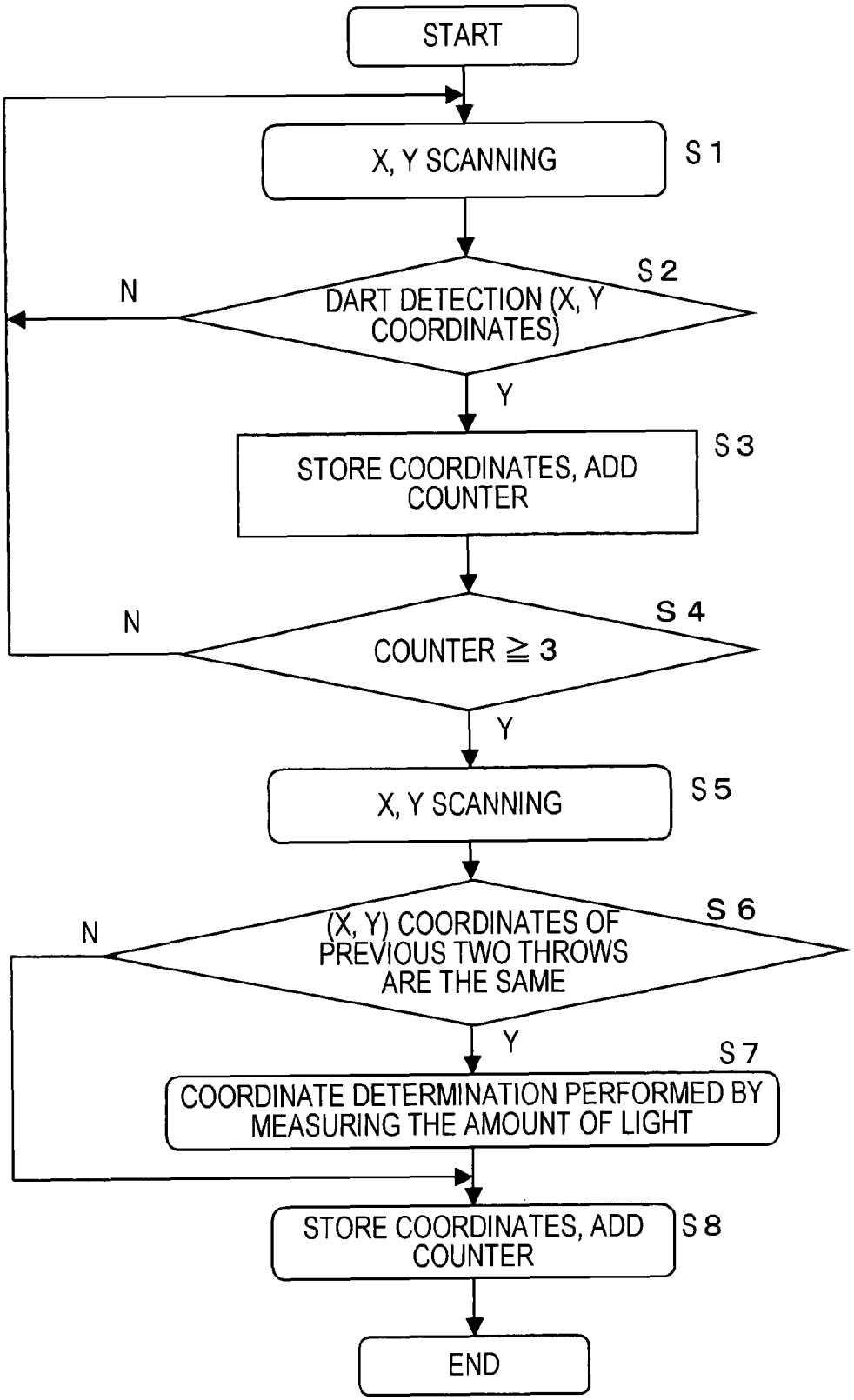
FIG. 12 is a flow diagram of detection processing according to Embodiment 4.

FIG. 12 is a flow diagram of detection processing according to Embodiment 4.

First, the light-receiving elements on the X and Y sides are scanned (step S1), the X and Y coordinate positions of the soft dart on the panel body 20 are specified by means of the change (FIG. 11A to FIG. 11B) in the amount of received light obtained by the soft dart inserted at one coordinate position (step S2).

The detected coordinate positions are stored in the memory section 42, and a counter value is added (step S3).

Since the counter value is not yet 3, this process returns to the step S1 to similarly detect the position of the second soft dart. Next, once the counter value becomes 3 (step S4, Y), the light-receiving elements on the X and Y sides are scanned (step S5). If the positions of the light-receiving elements on the X and Y sides are the same as the X and Y coordinates of each of the previous two soft darts (step S6, Y), the three coordinates are determined by measuring the changes in the amount of received light, as described in FIG. 10 and FIG. 11 (step S7).

The determined coordinates are stored in the memory section 42, a counter value is added thereto, and thus obtained result is used in appropriate program processing (step S8).

Embodiment 4

Figure 13:
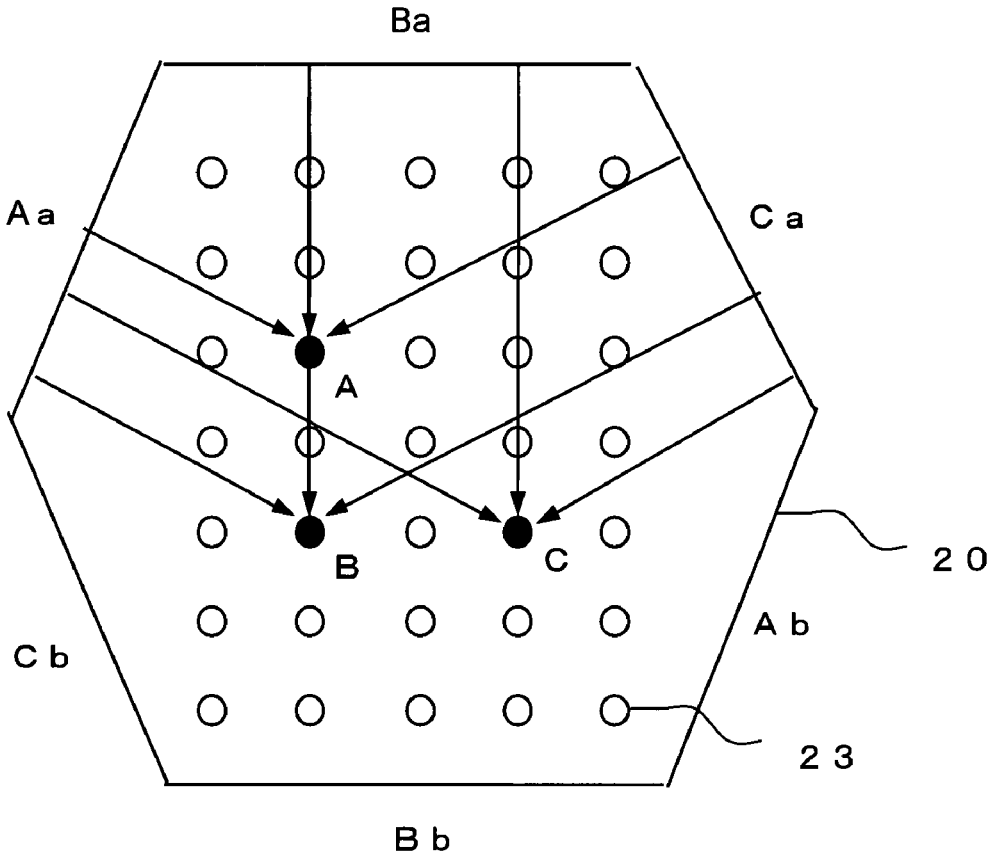
FIG. 13 is an embodiment in which a first detection layer 22 and a second detection layer 23 are integrated, unlike Embodiment 2 shown in FIG. 9.

FIG. 13 shows an embodiment in which the first detection layer 22 and the second detection layer 23 are integrated, unlike Embodiment 2 shown in FIG. 9. There are rim sides forming a hexagon in which opposing rim sides are arranged so as to be parallel to each other. A pair of the light-emitting sensor section and the light-receiving sensor section for detecting light emission of the light-emitting sensor section are provided on each one of three pairs of rims arranged parallel and face-to-face, so as to correspond to the hexagon (Aa-Ab, Ba-Bb, Ca-Cb).

Two light-receiving sensor sections in the three pairs detect blockage of light emissions of the light-emitting sensor sections by not more than two soft darts inserted into the panel body, to detect the coordinates of the position of each of the two soft darts. Then, another one of the light-receiving sensor sections in the three pairs detects blockage of light emissions of the light-emitting sensor sections by the third soft dart inserted into the panel body, to detect the coordinates of the position of the third soft dart.

Specifically, the pair of the light-emitting sensor section Aa and the light-receiving sensor section Ab, the pair of the light-emitting sensor section Ba and the light-receiving sensor section Bb, and the pair of the light-emitting sensor section Ca and the light-receiving sensor section Cb are disposed in the form of a hexagon, each pair being disposed so as to face each other on the outer circumference of the plurality of holes 23 provided on the panel body 20. In this manner, one light-receiving layer is formed. Accordingly, as described in FIG. 9, the coordinate positions can be detected from three directions, and determination can be made without causing the position of the third soft dart to overlap with the coordinates of each of the other soft darts.

Other Embodiments

Other configuration embodiment of the coordinate detecting device can be implemented by providing a reflection-type sensor on one of the opposing rim sections and attaching a mirror function that reflects the surface of the other rim section.

According to the above descriptions, although the display device capable of displaying a moving image is used in order to display the target, when a fixed target is displayed without displaying a moving image as in the prior art, a wall paper having a picture of the target or an actual target plate may be disposed in place of the image display device. In the case of the wall paper in which a picture of a target is drawn, a translucent screen may be lit up from behind by using fluorescent light or the like so as to obtain good visual quality. In this method, each coordinate position on the panel body is allocated to the coordinates of each segment on the target in advance, and the allocated positions are stored in the memory section, whereby the position into which the soft dart is inserted can be detected by the coordinate detecting body.

Furthermore, in the descriptions of the above embodiments, the coordinate detecting device 30 of the soft dart 5 is provided in front of the panel body 20. However, the coordinate detecting device 30 may be positioned between the image display device 10 and the panel body 20 as long as the soft tip of the soft dart 5 is designed to protrude out to the back of the panel body 20.

The coordinate detecting device 30 having the configurations described in the present application monitors the detection signal by means of the light-receiving sensors, even when the soft dart 5 is slightly inserted into the panel body 20 configured as the target but falls without being completely inserted, thus an insertion failure can be detected. Moreover, even when the soft dart 5 hits the panel body 20 but falls without being inserted, such detection can be performed. In these cases, throws of the soft dart do not count as points, but one throw of the soft dart is detected, thus the game can be played according to the original rules of a dart game.

The detection light beams of the optical sensors are disposed vertically, horizontally, and obliquely on the flat surface with respect to the panel body 20, thus the coordinate detecting device 30 can securely detect the positions of the three soft darts 5 thrown in one round of a dart game. Furthermore, even when the soft dart hits the panel body 20 but falls without being inserted into the panel body 20, the fact that the soft dart hit the dart board can be detected and the fact that the dart was thrown can be detected, thus determination can be made according to the original rules of the dart game.

According to the present invention, the pattern or size of the target can be changed by changing the display of the image display device 10, as a result of which coordinate detection can be performed, thus determination can be securely made as to whether the soft dart hits or not.

In addition, the position of the target image displayed by the image display device 10 is moved by a software program, thus the target can be moved. Therefore, a non-conventional dart game can be enjoyed.

The invention claimed is:

1. A dart game apparatus, comprising:

an image display body which displays an image of a target;

a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed; and a coordinate detecting body which is disposed on a front surface of the panel body and detects coordinates of the position of the soft dart, the end of which is inserted into any of the plurality of holes, wherein the coordinate detecting body has at least four rims, in which, so as to correspond to the four rims, two pairs of a light-emitting sensor section and a light-receiving sensor section for detecting light emitted by the light-emitting sensor section are provided respectively on the rims arranged face-to-face in parallel, and the light-receiving sensor sections out of the two pairs detect blockage of light emissions of the light-emitting sensor sections by the soft dart inserted into the panel body, whereby the coordinates of the position of the soft dart are detected.

2. The dart game apparatus used to play soft darts according to claim 1, wherein the holes in the panel body are arranged vertically and horizontally at regular intervals in the form of a grid, and optical axes of the optical sensors of the coordinate detecting body layer are disposed at intervals such that the optical axes intersect with each other at a position corresponding to a substantially center line of each hole on the panel body.

3. The dart game apparatus according to claim 1, wherein at least the end of the soft dart has flexibility, and, on the panel body, a plurality of holes each having a cross-sectional size substantially the same as that of the end of the soft dart are arranged at a predetermined interval in the form of a matrix, and an inclined surface extending toward each hole is formed in a ridge taken as a border between adjacent holes.

4. A dart game apparatus, comprising:

an image display body which displays an image of a target;

a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed; and a first coordinate detecting body layer and a second coordinate detecting body layer, each of which has four rims, and in each of which, so as to correspond to the four rims, two pairs of a light-emitting sensor section and a light-receiving sensor section for detecting light emitted by the light-emitting sensor section are provided respectively on the rims arranged face-to-face in parallel, wherein the second coordinate detecting body layer is disposed at a predetermined displacement angle with respect to the first coordinate detecting body layer, the light-receiving sensor sections out of the two pairs provided in the first coordinate detecting body layer detect blockage of light emissions of the light-emitting sensor sections by not more than two soft darts inserted into the panel body, whereby coordinates of the position of each of the two soft darts are detected, and the light-receiving sensor sections out of the two pairs provided in the second coordinate detecting body layer detect blockage of light emissions of the light-emitting sensor sections by a third soft dart inserted into the panel body, whereby coordinates of the position of the third soft dart are detected.

5. A dart game apparatus, comprising:

an image display body which displays an image of a target;

a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed;

a coordinate detecting body which is disposed on a front surface of the panel body and detects coordinates of the position of the soft dart, the end of which is inserted into any of the plurality of holes;

a target coordinate storage section that stores a position coordinate of the image of the target displayed on the image display body;

a determination section which calculates a coordinate position of the position of the soft dart inserted into the panel body, by means of a detection signal sent from the coordinate detecting body, and determines whether the coordinate position matches the position coordinate stored in the target coordinate storage section; and a reporting section which reports a result of determination made by the determination section.

6. The dart game apparatus according to claim 5, wherein detection time for detecting the detection signal of each optical sensor of the coordinate detecting body is compared with predetermined reference time, and when the detection time is shorter, the determination section determines that the soft dart is not inserted into a dart board, and when the detection time is longer, the determination section determines that the soft dart is inserted into a dart board, and notifies the reporting section of the results of determination.

7. The dart game apparatus according to claim 6, wherein when determination is made that the soft dart is not inserted into the dart board, the soft dart is counted as one throw, which is then reported to the reporting section, and when determination is made that the soft dart is inserted into the dart board, the soft dart is counted as one throw, which is then reported to the reporting section along with score information corresponding to the detection signal.

8. A dart game apparatus, comprising:

an image display body which displays an image of a target;

a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed;

a first coordinate detecting body layer and a second coordinate detecting body layer, each of which has four rims, and in each of which, so as to correspond to the four rims, two pairs of a light-emitting sensor section and a light-receiving sensor section for detecting light emitted by the light-emitting sensor section are provided respectively on the rims arranged face-to-face in parallel, the second coordinate detecting body layer being disposed at a predetermined displacement angle with respect to the first coordinate detecting body layer, the dart game apparatus further comprising:

a target coordinate storage section which stores a position coordinate of the image of the target displayed on the image display body;

a determination section which calculates a coordinate position of the position of the soft dart inserted into the panel body, by means of detection signals sent from the first and second coordinate detecting body layers, and determines whether the coordinate position matches the position coordinate stored in the target coordinate storage section; and a reporting section which reports a result of determination made by the determination section.

9. A dart game apparatus, comprising:

an image display body which displays an image of a target;

a substantially transparent panel body, in which a plurality of holes each having a cross-sectional size substantially the same as that of an end of a soft dart are adjacent to each other and an inclined surface extending toward each hole is formed in a ridge taken as a border between adjacent holes, and which is provided in front of the image display body;

a coordinate detecting body in which a plurality of optical sensors are provided face-to-face in a plurality of intersecting directions on rims surrounding the panel body in order to detect coordinates of the position of the soft dart, the end of which is inserted into a hole of the panel body, the coordinate detecting body being provided along a surface of the panel body that emits a detection signal sent from each sensor in each of the intersecting directions;

an information storage section which stores image information and position information of the image displayed on the image display body;

an image controller which reads the image information from the information storage section to generate an image generation signal, and displays the image on the image display body;

a coordinate position calculating section which calculates the position of the soft dart inserted into the panel body, by means of the detection signal from the coordinate detecting body;

a determination section which uses coordinate information calculated by the coordinate position calculating section to determine whether the coordinates of the position of the soft dart match a position coordinate of the image of the target, the position coordinate being stored in the information storage section; and a reporting section which reports a result of determination made by the determination section.

10. A dart game apparatus, comprising:

an image display body which displays an image of a target;

a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed;

a first coordinate detecting body layer and a second coordinate detecting body layer, each of which has four rims, and in each of which, so as to correspond to the four rims, two pairs of a light-emitting sensor section and a light-receiving sensor section for detecting light emitted by the light-emitting sensor section are provided respectively on the rims arranged face-to-face in parallel, the second coordinate detecting body layer being disposed at a predetermined displacement angle with respect to the first coordinate detecting body layer, the dart game apparatus further comprising:

an information storage section which stores image information and position information of the image displayed on the image display body;

an image controller which reads the image information from the information storage section to generate an image generation signal, and displays the image on the image display body;

a coordinate position calculating section which calculates the position of the soft dart inserted into the panel body, by means of detection signals from the first and second coordinate detecting bodies;

a determination section which uses coordinate information calculated by the coordinate position calculating section to determine whether the coordinates of the position of the soft dart match a position coordinate of the image of the target, the position coordinate being stored in the information storage section; and a reporting section which reports a result of determination made by the determination section.

11. A dart game apparatus, comprising:

an image display device having a display screen on which an arbitrary static image or moving video image of a target is electrically displayed;

a panel body which is disposed on a front surface of the display screen of the image display device and through which the arbitrary static image or moving video image electrically displayed on the display screen of the image display device can be observed; and which holds a soft dart; and a coordinate position detecting device which detects a coordinate position of the soft dart held on the panel body.

12. A dart game apparatus, comprising:

an image display body which displays an image of a target;

a panel body, which has a plurality of holes each having a cross-sectional size substantially the same as that of an end of a soft dart, which is also formed, extending toward each hole, with an inclined surface in a ridge taken as a border between adjacent holes, and which is disposed in front of the image display body, and through which the image can be observed; and a coordinate detecting body which is disposed on a front surface of the panel body and detects coordinates of the position of the soft dart, the end of which is inserted into any of the plurality of holes, wherein the coordinate detecting body has rims forming a hexagon where opposing rims are disposed parallel, in which, so as to correspond to the hexagon, three pairs of a light-emitting sensor section and a light-receiving sensor section for detecting light emitted by the light-emitting sensor section are provided respectively on the rims arranged face-to-face in parallel and, two pairs of the light-receiving sensor sections out of the three pairs detect blockage of light emissions of the light-emitting sensor sections by not more than two soft darts inserted into the panel body, whereby coordinates of the position of each of the two soft darts are detected, and another pair of the light-receiving sensor sections out of the three pairs detects blockage of light emissions of the light-emitting sensor sections by a third soft dart inserted into the panel body, whereby coordinates of the position of the third soft dart are detected.

* * * * *